US006841325B2

(12) United States Patent
Ueda et al.

(10) Patent No.: US 6,841,325 B2
(45) Date of Patent: Jan. 11, 2005

(54) ELECTROSTATIC-LATENT-IMAGE DEVELOPING TONER

(75) Inventors: Hideaki Ueda, Kishiwada (JP); Shino Hirao, Osaka (JP); Masahiro Anno, Sakai (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/352,918

(22) Filed: Jan. 29, 2003

(65) Prior Publication Data

US 2004/0067429 A1 Apr. 8, 2004

(30) Foreign Application Priority Data

Oct. 4, 2002 (JP) ..... 2002-292110

(51) Int. Cl.[7] ..... G03G 9/08
(52) U.S. Cl. ..... 430/108.4; 430/109.3; 430/137.14; 430/137.15
(58) Field of Search ..... 430/108.4, 109.3, 430/137.14, 137.15

(56) References Cited

U.S. PATENT DOCUMENTS

| | | | | |
|---|---|---|---|---|
| 5,605,778 | A * | 2/1997 | Onuma et al. | 430/108.8 |
| 5,741,617 | A | 4/1998 | Inaba et al. | |
| 6,117,605 | A | 9/2000 | Chiba | |
| 6,203,959 | B1 * | 3/2001 | Tanikawa et al. | 430/108.8 |
| 6,436,599 | B1 * | 8/2002 | Matsuoka et al. | 430/137.19 |
| 6,475,685 | B2 * | 11/2002 | Uchida et al. | 430/99 |
| 6,537,716 | B1 * | 3/2003 | Doi et al. | 430/108.23 |
| 6,632,577 | B2 * | 10/2003 | Akashi et al. | 430/125 |
| 2001/0026899 | A1 | 10/2001 | Uchida et al. | |

* cited by examiner

*Primary Examiner*—John L Goodrow
(74) *Attorney, Agent, or Firm*—Burns, Doane, Swecker & Mathis, L.L.P.

(57) ABSTRACT

The present invention relates to an electrostatic-latent-image developing toner which contains at least a binder resin, a coloring agent and a wax that does not exhibit a clear peak on a low-temperature side of a main fusing peak in a DSC curve, the wax being represented by the formula; $R_1$—(OCO—$R_2$)$_n$ in which $R_1$ and $R_2$ independently represent a hydrocarbon group having 1 to 40 carbon atoms that may have a substituent, and n is an integer of 1 to 4.

19 Claims, 2 Drawing Sheets

ELECTROSTATIC-LATENT-IMAGE DEVELOPING TONER

This application is based on application(s) No. 2002-292110 filed in Japan, the contents of which is hereby incorporated by reference.

BACKGROUND OF THE INVENTION

1. Field of the Invention

The present invention relates to an electrostatic-latent-image developing toner that is used for developing electrostatic latent images in processes such as an electronic photographing process, an electrostatic recording process and an electrostatic printing process.

2. Description of the Related Art

Conventionally, the electrostatic-latent-image developing toner, which contains at least a binding resin, a coloring agent and a wax, is prepared by using a method such as a so-called pulverizing method, a suspension polymerization method, an emulsion polymerizing coagulation method and an emulsion dispersing method. With respect to the wax, commercially available wax, such polyethylene wax, oxidation-type polyethylene wax, polypropylene wax, oxidation-type polypropylene wax and carnauba wax, is generally used. In general, an image-forming device which uses such a toner is provided with a cleaning mechanism for cleaning residual toner on the surface of a photosensitive member.

However, even when the conventional toner is used in an image-forming apparatus provided with such a cleaning mechanism, fused toner and residual toner after cleaning process are generated, failing to carry out a sufficient cleaning process. Such an insufficient cleaning process causes a defective image portion on an image due to the defective cleaning operation.

In particular, the toner granulated by using the emulsion polymerizing coagulation method tends to be susceptible to insufficient cleaning, and has a narrower permissible range of waxes to be used, with the result that a complicated wax selection is required.

The conventional toner tends to easily adhere to members such as a developing roller, a fixing roller and a developing sleeve, causing problems of insufficient charging, insufficient fixing and image losses.

Furthermore, the conventional toner tends to cause a problem of roughness due to granular density irregularities that appear on an image obtained after the fixing process (hereinafter, referred to as "granular noise").

Therefore, in order to obtain a good image, a toner which contains a specific ester compound as a wax has been proposed (for example, Japanese Patent Laid-Open Publication No. 2001-318484 (pages 2 to 3)). The application of the toner of this type caused the granular noise during endurance printing processes, although it can prevent the granular noise in the initial stage. Moreover, although the cleaning property is slightly improved, it is still insufficient. The problem of insufficient cleaning is particularly conspicuous at the time of the endurance printing processes.

SUMMARY OF THE INVENTION

One of the objectives of the present invention is to provide an electrostatic-latent-image developing toner which can prevent the generation of insufficient cleaning and adhesion of toner to parts such as rollers for a long time.

Another objective of the present invention is to provide an electrostatic-latent-image developing toner which can prevent the generation of insufficient cleaning, granular noise and adhesion of toner to parts such as rollers for a long time, and enables an oil-less fixing process.

The inventors of the present invention have directed their attention to components having a comparatively low melting point, which are contained in a wax, and found that such components have caused problems of insufficient cleaning and toner adhesion to the parts such as rollers; thus, they have made the present invention.

The present invention relates to an electrostatic-latent-image developing toner which contains at least a binding resin, a coloring agent and a wax that does not exhibit a clear peak on a low-temperature side of a main fusing peak in a DSC curve.

DESCRIPTION OF THE PREFERRED EMBODIMENTS

An electrostatic-latent-image developing toner of the present invention contains at least a binding resin, a coloring agent and a specific wax.

The wax to be used in the present invention has such a characteristic that it does not exhibit a clear peak on the low temperature side of a main fusing peak in a DSC curve. The term "does not exhibit a clear peak" indicates that with respect to the peak height in the DSC curve, it does not exhibit any peak having a height of not less than 5% of the height of the main fusing peak. In other words, the wax which is applicable to the present invention does not exhibit any peaks having a height of not less than 5% of the height of the main fusing peak on the low temperature side of the main fusing peak in a DSC curve.

Figure 2:
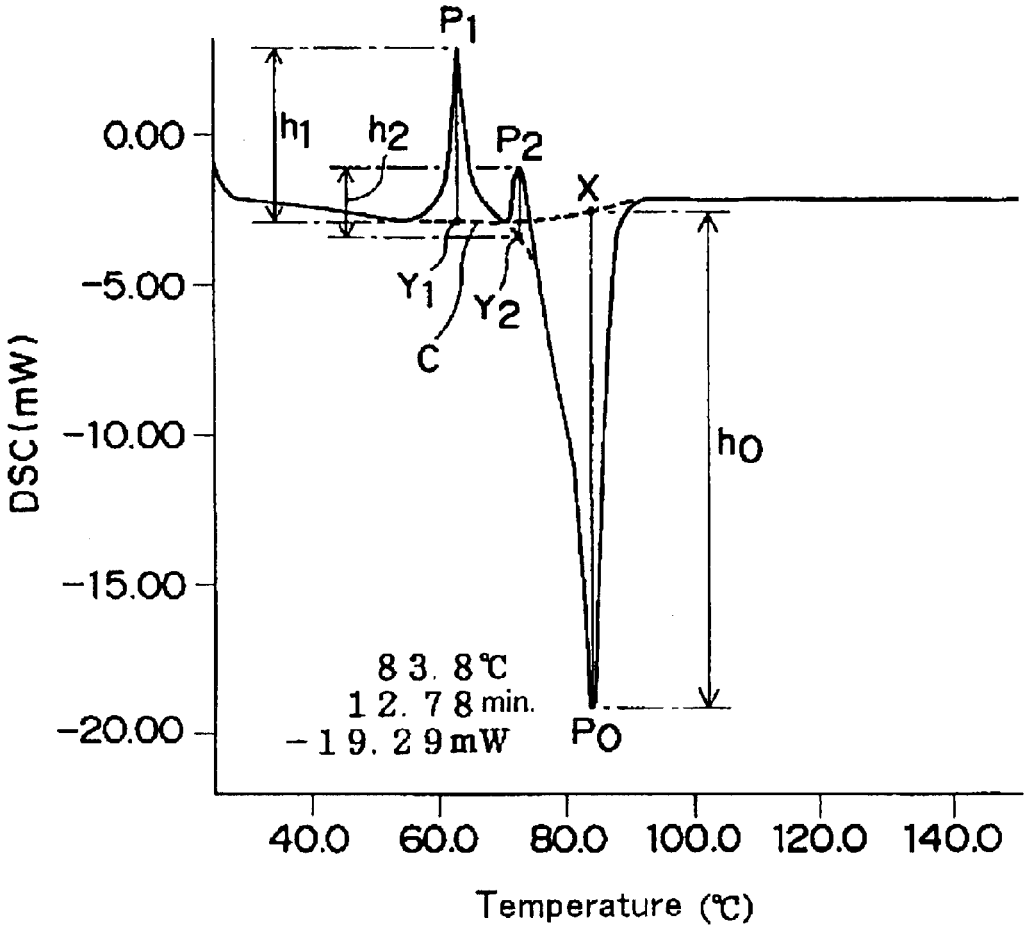
FIG. 2 shows a DSC curve of a wax used in Comparative Example 1.

In the present specification, it is supposed that the main fusing peak indicates a peak apex of which reaches the lowest DSC value (mW) among peaks appearing in a DSC curve (for example, in FIG. 2, peak $P_0$) . For example, as shown in FIG. 2, supposing that the crossing point between a perpendicular drawn from the main peak apex and the base line in the DSC curve is represented by X, the height of the main fusing peak is indicated by a distance $h_0$ between the corresponding main peak apex and the point X. Here, the perpendicular is a straight line orthogonal to the axis of abscissa of the graph representing the DSC curve.

Supposing that the crossing point between a perpendicular drawn from the peak apex and a refined DSC curve C is represented by Y, the height of a peak that appears on the low temperature side of the main fusing peak is indicated by the distance between the peak apex and the point Y (for example, in FIG. 2, distance $h_1$ between the apex of peak $P_1$ and point $Y_1$, distance $h_2$ between the apex of peak $P_2$ and point $Y_2$) . The refined DSC curve C is obtained as follows: When a wax, which has a peak on the low temperature side of the main fusing peak as shown in FIG. 2, comes to have no peak on the low temperature side due to a refining process, a DSC curve of the corresponding refined wax forms the refined DSC curve C.

Figure 1:
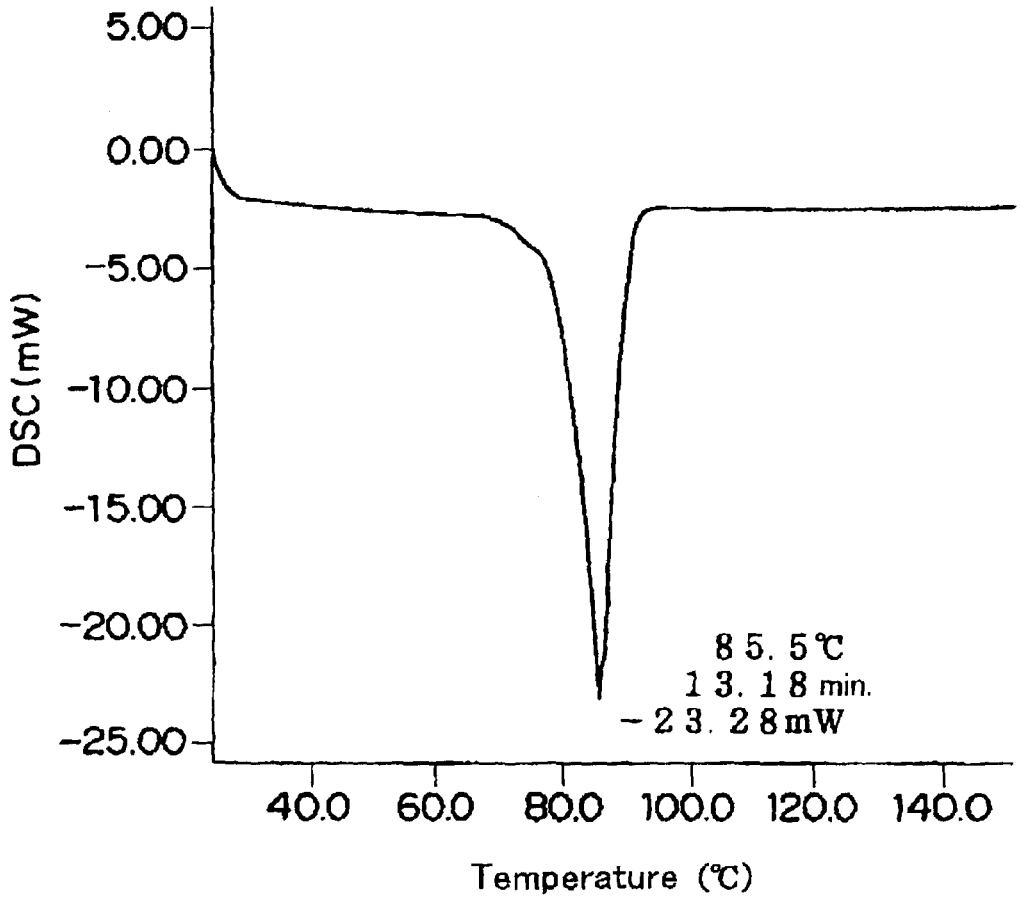
FIG. 1 shows a DSC curve of a wax used in Example 1.

Referring to FIGS. 1 and 2, the following description will explain waxes that are applicable to the present invention in detail. FIG. 1 shows a DSC curve of waxes that are applicable to the present invention, and in the corresponding curve, none of the other peaks appear on the low temperature side of the main fusing peak in the corresponding curve, that is, in a range of less than 85.5° C. FIG. 2 shows a DSC curve of waxes that are not applicable to the present invention, and in the corresponding curve, peaks $P_1$ and $P_2$ appear on the low temperature side of the main fusing peak $P_0$, that is, in a range of less than 83.8° C. In FIG. 2, each of heights $h_1$ and $h_2$ of peaks $P_1$ and $P_2$ is not less than 5% with respect to height $h_0$ of the main fusing peak $P_0$.

In the present invention, the wax is not necessarily prepared so that it has no peak on the low temperature side of the fusing peak. It may have peaks on the low temperature side of the fusing peak, as long as the height of the highest peak among the peaks is less than 5% of the height of the main fusing peak. For example, even when there are peaks on the low temperature side of the fusing peak as shown in FIG. 2, it is permissible as long as height $h_1$ of the highest peak $P_1$ is less than 5% of height $h_0$ of main fusing peak $P_0$.

With respect to the DSC curves, the present invention uses those obtained by using the following measuring device and measuring conditions.

Measuring device: Differential Scanning Calorimeter DSC220 made by Seiko Denshi K. K.

Measuring condition: Quantity of sample: 10 mg,

Temperature rising rate: 5° C./min.

The above-mentioned device is not necessarily used as the measuring device. Any device may be used as long as it can measure the DSC curve, and adopt the above-mentioned measuring conditions.

More specifically, the sample is put into a container in the DSC device, and after the device is stabilized at a temperature that is lower than the fusing peak by at least approximately 50° C., the sample is heated to a temperature approximately 30° C. higher than the temperature at the time of completion of the fusing peak at a heating rate of 5° C. per minute. Thus, the DSC curve is measured.

With respect to the DSC curve, for example, the DSC curve shown in FIG. 2 has peaks appearing on the low temperature side of the main peak, which extend upward on the drawing. However, these may extend downward. In this case, the height of the corresponding peaks is represented by the same manner as the above-mentioned "height of peaks appearing on the low temperature side of the main fusing peak".

In the present invention, in an attempt to make an unapplicable wax applicable, the unapplicable wax is refined. More specifically, for example, a wax compound is heated and fused. The resultant fused compound is cooled off to a specific temperature so that the deposited solid component is extracted as a refined compound. For example, in the case when a wax shown in the DSC curve of FIG. 2 is refined, normally, the heating temperature is set to approximately 90° C., the cooling rate is set to approximately 15° C./minute, and the cooling temperature is set to approximately 84° C.

In order to make the above-mentioned wax more positively usable, the above-mentioned refining process may be carried out repeatedly, and/or the level of the refining process may be raised. The term "raising the level of the refining process" indicates that the cooling process is carried out more slowly.

The kind of the wax to be used of the present invention is not particularly limited as long as it does not exhibit a clear peak on the low temperature side of the main fusing peak in the DSC curve, and examples thereof include: ester-based waxes; polyolefin-based waxes such as polyethylene wax, polypropylene wax, oxidation-type polyethylene wax and oxidation-type polypropylene wax; natural waxes such as carnauba wax and rice wax; paraffin based waxes; and high molecular alcohol waxes. In an attempt to prevent the generation of granular noise for a long time and also to make the resultant toner capable of an oil-less fixing process, it is preferable to use ester-based waxes among these waxes. The application of an ester-based wax makes it possible to effectively prevent the generation of insufficient cleaning and adhesion of toner to the parts such as rollers for a long time.

An ester-based wax preferably used in the present invention is represented by the following formula (I):

$$R_1—(OCO—R_2)_n \quad (I)$$

In formula (I), each of $R_1$ and $R_2$ independently represents a hydrocarbon group having 1 to 40 carbon atoms that may have a substituent, and n is an integer of 1 to 4. When n is set to 2 to 4, 2 to 4 —(OCO—$R_2$) groups may be same or different.

More specifically, when n is 1, $R_1$ is a monovalent hydrocarbon group having 1 to 40 carbon atoms, preferably 3 to 25, more preferably 15 to 25 carbon atoms that may have a substituent (for example, a hydroxyl group and an alkoxy group). $R_2$ is a monovalent hydrocarbon group having 1 to 40 carbon atoms, preferably 10 to 30 more preferably 10 to 25 carbon atoms that may have a substituent (for example, a hydroxyl group and an alkoxy group). In the case when n is 1, specific examples of preferable ester-based waxes include the following compounds (1) to (4) and (14) to (15).

When n is 2, $R_1$ is a divalent hydrocarbon group having 1 to 40 carbon atoms, preferably 3 to 20, more preferably 3 to 10 carbon atoms, that may have a substituent (for example, a hydroxyl group and an alkoxy group). $R_2$ is a monovalent hydrocarbon group having 1 to 40 carbon atoms, preferably 15 to 35, more preferably 20 to 30 carbon atoms that may have a substituent (for example, a hydroxyl group and an alkoxy group). In the case when n is 2, specific examples of preferable ester-based waxes include the following compounds (5) to (9) and (12) to (13).

When n is 3, $R_1$ is a trivalent hydrocarbon group having 1 to 40 carbon atoms, preferably 1 to 20, more preferably 3 to 10 carbon atoms, that may have a substituent (for example, a hydroxyl group and an alkoxy group). $R_2$ is a monovalent hydrocarbon group having 1 to 40 carbon atoms, preferably 15 to 35, more preferably 20 to 30 carbon atoms that may have a substituent (for example, a hydroxyl group and an alkoxy group). In the case when n is 3, specific examples of preferable ester-based waxes include the following compounds (10), (11), (16) and (17).

When n is 4, $R_1$ is a tetravalent hydrocarbon group having 1 to 40 carbon atoms, preferably 3 to 20, more preferably 3 to 10 carbon atoms, that may have a substituent (for example, a hydroxyl group and an alkoxy group). $R_2$ is a monovalent hydrocarbon group having 1 to 40 carbon atoms, preferably 1 to 30, more preferably 10 to 30 carbon atoms that may have a substituent (for example, a hydroxyl group and an alkoxy group). In the case when n is 4, specific examples of preferable ester-based waxes include the following compounds (18) to (22).

$$CH_3—(CH_2)_{12}—COO—(CH_2)_{17}—CH_3 \quad 1)$$

$$CH_3—(CH_2)_{13}—COO—(CH_2)_{17}—CH_3 \quad 2)$$

$$CH_3—(CH_2)_{20}—COO—(CH_2)_{21}—CH_3 \quad 3)$$

$$CH_3—(CH_2)_{14}—COO—(CH_2)_{19}—CH_3 \quad 4)$$

$$CH_3—(CH_2)_{20}—COO—(CH_2)_6—O—CO—(CH_2)_{20}—CH_3 \quad 5)$$

6)

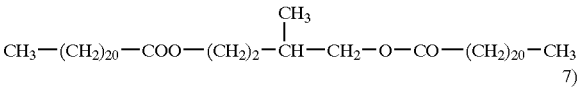

7)

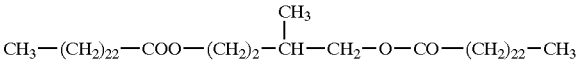

8)

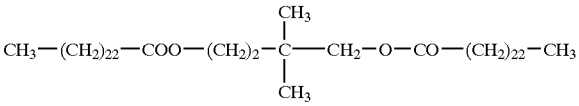

9)

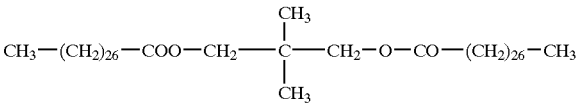

10)

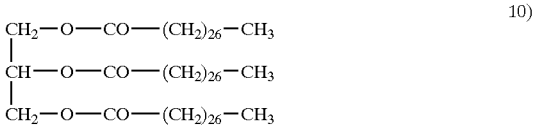

11)

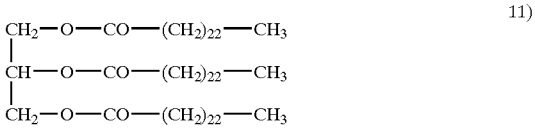

12)

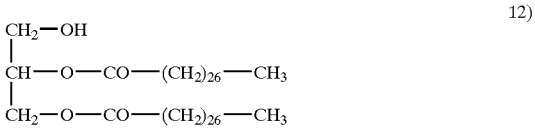

13)

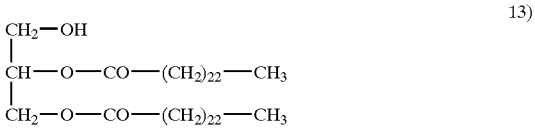

14)

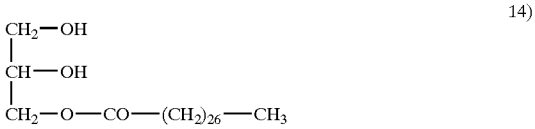

15)

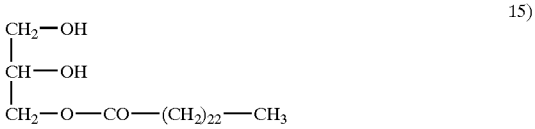

16)

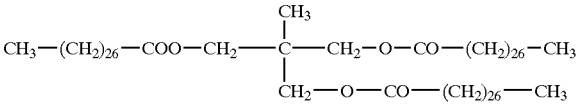

17)

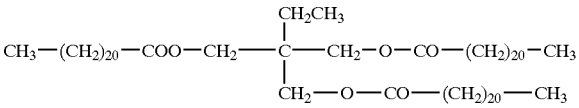

18)

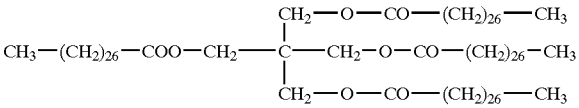

-continued

19)

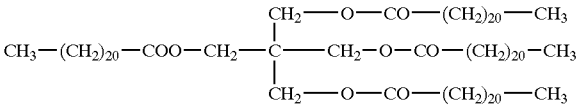

20)

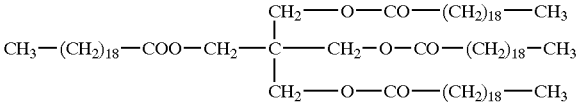

21)

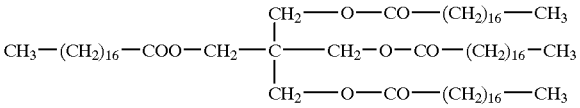

22)

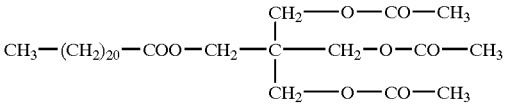

Among the above-mentioned ester-based waxes, those compounds having n of 1 or 4 are preferably used, and in particular, compounds (3) and (19) to (21) are preferably used.

The ester-based wax is easily synthesized through a known dehydrating condensation reaction between predetermined alcohol and carboxylic acid that correspond to a desired wax structure.

The melting point of the wax is preferably 60 to 110° C., more preferably 70 to 100° C. The melting point of the wax is represented by a temperature at which the main fusing peak appears on the above-mentioned DSC curve.

Although not particularly limited, a content of the wax is normally set to 1 to 25 parts by weight, preferably 1 to 20 parts by weight, more preferably 5 to 15 parts by weight, with respect to 100 parts by weight of binder resin.

With respect to the binding resin, those publicly known resins may be used. Examples thereof include: styrene resins made from a styrene-based monomer, acrylic resins made from an alkyl(meth)acrylate-based monomer, styrene-acrylic copolymer resins made from at least a styrene-based monomer and an alkyl(meth)acrylate-based monomer, vinyl resins made from a vinyl-based monomer, polyester resins, epoxy resins, silicone resins, olefin resins and amide resins. These may be used alone or may be used in a mixed manner.

Specific examples of styrene monomers that form styrene resins and styrene-acrylic copolymer resins include: styrene, methylstyrene, methoxystyrene, ethylstyrene, propylstyrene, butylstyrene, phenylstyrene and chlorostyrene.

Specific examples of alkyl(meth)acrylate-based monomers that form acrylic resins and styrene-acrylic copolymer resins include: methyl acrylate, ethyl acrylate, propyl acrylate, butyl acrylate, pentyl acrylate, dodecyl acrylate, stearyl acrylate, ethylhexyl acrylate, lauryl acrylate, methyl methacrylate, ethyl methacrylate, propyl methacrylate, butyl methacrylate, pentyl methacrylate, dodecyl methacrylate, stearyl methacrylate, ethylhexyl methacrylate and lauryl methacrylate.

Specific examples of vinyl-based monomers forming vinyl resins include: acidic monomers, such as acrylic acid, methacrylic acid, maleic anhydride and vinyl acetate, acrylamide, methacrylamide, acrylonitrile, ethylene, propylene, butylene, vinyl chloride, N-vinyl pyrrolidone and butadiene. Vinyl monomers may be used as monomers that constitute styrene resins, acrylic resins and styrene-acrylic copolymer resins.

Preferable binding resins are different depending on manufacturing methods of a toner. When a wet method, in particular, an emulsion polymerizing coagulation method, is used, styrene-acrylic copolymer resins are preferably used. When a pulverizing method is used, styrene resins, acrylic resins, styrene-acrylic copolymer resins, vinyl resins and polyester resins are preferably adopted; and in particular, polyester resins are more preferably used.

In particular, with respect to monomers constituting styrene-acrylic copolymer resins, styrene and butyl(meth) acrylate are preferably used. A styrene-acrylic copolymer resin formed by such monomers is used together with the above-mentioned wax so that it becomes possible to effectively prevent the generation of insufficient cleaning and adhesion of toner to the parts such as rollers for a long time.

The copolymerization ratio (styrene monomer/alkyl (meth) acrylate-based monomer) between the styrene monomer and alkyl(meth)acrylate-based monomer in the styrene-acrylic copolymer resin is normally selected from a range of weight ratios of 20/80 to 90/10. In particular, in the case of styrene and butyl(meth)acrylate, the weight ratio is preferably set in a range of 40/60 to 90/10, more preferably 60/40 to 80/20. The copolymerization ratio of vinyl monomer with respect to the entire composition is normally set to not more than 20% by weight, more preferably not more than 10% by weight.

The styrene resins, acrylic resins, styrene-acrylic copolymer resins or vinyl resins may further contain a multi-functional vinyl compound as a copolymerizable component. The copolymerization of the multi-functional vinyl compound generates a gel component that is insoluble in tetrahydrofran. With respect to the multi-functional vinyl compound, examples thereof include: diacrylate of ethylene glycol, propylene glycol, butylene glycol and hexylene glycol; dimethacrylate of ethylene glycol, propylene glycol, butylene glycol and hexylene glycol; divinylbenzene; diacrylate or triacrylate of tertiary or more alcohols such as pentaerythritol and trimethylol propane;, and dimethacrylate or trimethacrylate of tertiary or more alcohols such as pentaerythritol and trimethylol propane. The copolymerization ratio of the multi-functional vinyl compound is normally set to 0.001 to 5% by weight, more preferably 0.003 to 2% by weight, most preferably 0.01 to 1% by weight. If the copolymerization ratio of the multi-functional vinyl compound is too high, disadvantages such as poor fixing property and poor transparency of an image on OHP are caused.

With respect to the polyester resin, a polyester resin, obtained by condensation-polymerizable publicly known polyhydric alcohol component and polyhydric carboxylic acid component, may be used. In particular, a polyester resin, which is formed by containing a bisphenol A alkylene oxide adduct as a main component of the polyhydric alcohol component and at least one kind select from the group consisting of terephthalic acid, fumaric acid dodecenyl succinic acid and benzene tricarboxylic acid as a main component of the polyhydric carboxylic acid component, is preferably used.

Whichever resin may be selected as the binder resin, the glass transition point of the binder resin is set to not more than 80° C., preferably 40 to 80° C., preferably 40 to 70° C. With respect to the maximum peak molecular weight of the binding resin, it is normally set to 7,000 to 200,000, preferably 20,000 to 150,000, more preferably 30,000 to 100,000, on a polystyrene conversion basis by the use of GPC (gel permeation chromatography). Two or more peaks of the molecular weight may exist; however, a single peak is preferable. The peak of the molecular weight distribution may have a shoulder portion, or may have a tailing portion on the high molecular weight side. The rate of the gel component in the binder resin with respect to the entire resin is normally set to not more than 40% by weight, more preferably not more than 20% by weight.

With respect to the coloring agents, the following various kinds and various colors of organic and inorganic pigments and dyes may be used. Examples of black pigments include carbon black, copper oxide, manganese dioxide, aniline black, activated carbon, non-magnetic ferrite, magnetic ferrite and magnetite. Examples of yellow pigments include chrome yellow, zinc yellow, iron oxide yellow, Mineral Fast Yellow, nickel titanium yellow, Navel Yellow, Naphthol Yellow S, Hansa Yellow G, Hansa Yellow 10G, Benzidine Yellow G, Benzidine Yellow GR, Quinoline Yellow Lake, Permanent Yellow NCG and Tartradine Lake. Examples of orange pigments include chrome red, molybdenum orange, Permanent Orange GTR, Pyrazolon Orange, Balkan Orange, Indanthrene Brilliant Orange RK, Benzidine Orange G and Indanthrene Brilliant Orange GK. Examples of red pigments include iron oxide red, red lead, Permanent Red 4R, Lithol Red, Pyrazolon Red, Watching Red, calcium salt, Lake Red C, Lake Red D, Brilliant Carmine 6B, Eosin Lake, Rhodamine Lake B, Alizarine Lake and Brilliant Carmine 3B. Examples of violet pigments include Manganese Violet, Fast Violet B and Methyl Violet Lake. Examples of blue pigments include Ultramarine Blue, cobalt blue, Alkali Blue Lake, Victoria Blue Lake, Phthalocyanine Blue, non-metal Phthalocyanine Blue, phthalocyanine blue derivative, Fast Sky Blue and Indanthrene Blue BC. Examples of green pigments include Chrome Green, chromium oxide, Pigment Green B, Marakite Green-Lake, Final Yellow Green G and Phthalocyanine Green. Examples of white pigments include zinc oxide, titanium oxide, zirconium oxide, aluminum oxide, calcium oxide, calcium carbonate and tin oxide. Examples of extender pigments include pearlite powder, barium carbonate, clay, silica, while carbon, talc, alumina white and kaolin. Examples of dyes include Rose Bengale, triphenylmethane dyes, monoazo dyes, cis-azo dyes, Rhodamine dyes, condensed azo dyes and phthalocyanine dyes.

These coloring agents may be used alone, or a plurality of these may be used in combination. A content of the coloring agents is normally set to 1 to 20 parts by weight, preferably 2 to 15 parts by weight with respect to 100 parts by weight of the binder resin. The content of the coloring agents greater than 20 parts by weight tends to cause degradation in the toner fixing property. The content smaller than 1 part by weight causes to fail to obtain desired image density.

The toner of the present invention may include other additives, such as a charge-controlling agent and magnetic particles.

With respect to the charge-controlling agent, various substances that apply a positive or negative charge through frictional charging may be used. With respect to the positive charge-controlling agent, examples thereof include Nigrosine dyes such as Nigrosine base ES (made by Orient Kagaku Kogyo K.K.); quaternary ammonium salts such as P-51 (made by Orient Kagaku Kogyo K.K.) and Copy Charge PX VP435 (made by Clarient International Ltd.), alkoxylated amine; alkyl amide; chelate molybdate pigment; and imidazole compounds such as PLZ1001 (Shikoku Kasei Kogyo K.K.). With respect to the negative charge-controlling agent, examples thereof include metal complexes such as Bontron S-22 (made by Orient Kagaku Kogyo K.K.), Bontron S-34 (made by Orient Kagaku Kogyo K.K.), Bontron E-81 (made by Orient Kagaku Kogyo K.K.), Bontron E-84 (made by Orient Kagaku Kogyo K.K.) and Spilon Black TRH (made by Hodogaya Kagaku Kogyo K.K.); thioindigo pigments; calix arene compounds such as Bontron E-89 (made by Orient Kagaku Kogyo K.K.); quaternary ammonium salts such as Copy Charge NX VP434 (made by Clarient International Ltd.); and fluorine compounds such as magnesium fluoride and carbon fluoride. With respect to metal complexes that form a negative charge-controlling agent, in addition to those described above, compounds having various structures, such as metal complexes of oxycarboxylic acid, metal complexes of dicarboxylic acid, metal complexes of amino acid, metal complexes of diketone acid, metal complexes of diamine, metal complexes having an azo-group-containing benzene-benzene derivative skeleton and metal complexes having an azo-group-containing benzene-naphthalene skeleton, may be used. A content of the charge-controlling agent is normally set to 0.01 to 10 parts by weight, more preferably 0.1 to 5 parts by weight with respect to 100 parts by weight of the binder resin.

The charge-controlling agent preferably have a particle size of approximately 10 to 100 nm, from the viewpoint of uniform dispersion. In the case when the agent that is commercially available has a particle size exceeding the upper limit of the above-mentioned range, the particle size thereof is preferably adjusted by using a known method such as a pulverizing process by the use of a jet mill or the like.

With respect to the magnetic particles, examples thereof include magnetite, y-hematite and various ferrites. A content of the magnetic particles is normally set to 0.1 to 20 parts by weight, more preferably 1 to 10 parts by weight with respect to 100 parts by weight of the binder resin.

The toner of the present invention is preferably designed to have a volume-mean particle size of 2 to 10 $\mu$m, preferably 3 to 7 $\mu$m.

The toner of the present invention may be prepared in accordance with a known preparation process as long as it includes the above-mentioned wax. With respect to the preparation method, for example, a dry method such as a pulverizing method and a wet method such as an emulsion polymerization method, a soap-free emulsion polymerization method, an emulsion polymerizing coagulation method, a suspension polymerization method and an emulsion dispersion method may be used. In the present invention, from the viewpoint of preparation costs, high image quality and high yield, a wet method, which can easily prepare toner particles having a comparatively small particle size with uniform particle size, is preferably adopted. Among the wet methods, in particular, the emulsion polymerization method, soap-free emulsion polymerization method, emulsion polymerizing coagulation method and suspension polymerization method have an advantage in that the energy required for preparing the toner is reduced in comparison with the emulsion dispersion method since these methods produce toner particles simultaneously as the resin is formed. Among these, the emulsion polymerizing coagulation method is best-suited from the viewpoint of a sharper toner particle-size distribution.

In the emulsion polymerizing method, a polymerizable composition, which includes a monomer, etc. used for forming a binder resin (such as the above-mentioned styrene-based monomer, alkyl(meth)acrylate-based monomer, vinyl-based monomer; hereinafter, referred to as "polymerizable monomer"), is emulsified and polymerized in an aqueous dispersion medium, and the resultant resin fine particles are associated and fused with at least a coloring agent in an emulsified state. The wax, charge-controlling agent, magnetic particles, etc. may be preliminarily contained in the polymerizable composition in an independent manner respectively, or may be associated and fused with the resin fine particles together with the coloring agent in an emulsified state.

The emulsifying polymerization process in the emulsion polymerizing coagulation method may be a so-called seed emulsifying polymerization method in which a polymerizable composition including a polymerizable monomer is emulsified and polymerized in an aqueous dispersion medium in the presence of seeds. In this case, the wax and charge-controlling agent are preliminarily emulsified and dispersed in an aqueous dispersion medium in an independent manner respectively, and may be used as seeds. Hereinafter, "emulsion polymerization" is defined so as to include the above-mentioned "seed emulsion polymerization".

The emulsion polymerization process may be carried out through multiple stages. In other words, a polymerizable composition is emulsified and polymerized in an aqueous dispersion medium in the presence of seeds or in the absence of seeds. After the resultant resin particle dispersion solution is mixed with an aqueous dispersion medium prepared in a separated manner, a polymerizable composition, prepared in a separated manner, is further mixed and stirred therewith so as to be emulsified and polymerized. These processes may be further carried out repeatedly. By carrying out the emulsion polymerization process through multiple stages, it is possible to control the thermal characteristics of the resin as desired.

In the case when the emulsion polymerization process is carried out through multiple stages, normally, emulsion polymerization processes of total three times are carried out. When the multiple-stage emulsion polymerization processes are carried out with a wax, a charge-controlling agent and magnetic particles, etc., particularly, a wax, being added to the polymerizable composition, it is not necessary to add the wax and the like to all the polymerizable compositions to be used to all the emulsion polymerization processes. In the case when the emulsion polymerization processes of total three times are carried out, it is preferable to add the wax and the like to the polymerizable composition that is used in the emulsion polymerization process at the second time.

Normally, a polymerization initiator and a dispersion stabilizer are added to the aqueous dispersion medium.

With respect to the polymerization initiator, a water-soluble polymerization initiator is preferably used. More specifically, examples thereof include: peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium peroxide, sodium peroxide, potassium peroxide, diisopropyl peroxycarbonate, tetraphosphor hydroperoxide, 1-phenyl-2-methylpropyl-1-hydroperoxide, tert-butylhydroperoxide pertriphenyl acetate, tert-butyl performate, tert-butyl peracetate, tert-butyl perbenzoate, tert-butyl perphenyl acetate, tert-butyl permethoxyacetate, tert-butyl per-N-(3-tolyl)palmitic acid; azo compounds such as 2,2'-azobispropane, 2,2'-dichloro-2,2'-azobispropane, 1,1'-azo (methylethyl)diacetate, 2,2'-azobis(2-amidinopropane) hydrochloride, 2,2'-azobis-(2-amidinopropane) nitrate, 2,2'- azobisisobutane, 2,2'-azobisisobutyl amine, 2,2'-azobisisobutylonitrile, 2,2'-azobis-2-methyl metyl propionate, 2,2'-dichloro-2,2'-azobisbutane, 2,2'-azobis-2-methylbutylonitrile, 2,2'-azobisisodimethyl lactate, 1,1'-azobis (1-methylbutylonitrile-3-sodium sulfonate), 2-(4-methylphenylazo)-2-methylmalonodinitrile, 4,4'-azobis-4-cyanovalerate, 3,5-dihydroxymethylphenylazo-2-methylmalonodinitrile, 2-(4-bromophenylazo)-2-allylmalonodinitrile, 2,2'-azobis-2-methylvaleronitrile, 4,4'-azobis-4-cyanodimethylvalerate, 2,2'-azobis-2,4-dimethylvaleronitrile, 1,1'-azobiscyclohexane nitrile, 2,2'-azobis-2-propylbutylonitrile, 1,1'-azobis-1-chlorophenyl ethane, 1,1'-azobis-1-cyclohexane carbonitrile, 1,1'-azobiscyclohexane nitrile, 2,2'-azobis-2-propylbutylonitrile, 1,1'-azobis-1-chlorophenyl ethane, 1,1'-azobis-1-cyclohexane carbonitrile, 1,1'-azobis-1-cycloheptane carbonitrile, 1,1'-azobis-1-phenyl ethane, 1,1'-azobis cumene, 4-nitrophenylazobenzyl cyanoethyl acetate, phenylazodiphenyl methane, phenylazotriphenyl methane, 4-nitrophenylazotriphenyl methane, 1,1'-azobis-1,2-diphenyl ethane, poly(bisphenol A-4,4'-azobis-4-cyano pentanoate) and poly(tetraethyleneglycol-2,2'-azobisisobutylate); 1,4-bis(pentaethylene)-2-tetracene, 1,4-dimethoxycarbonyl-1,4-diphenyl-2-tetracene, etc. Not particularly limited, normally, an amount of addition of the polymerization initiator is preferably set to 0.01 to 5% by weight, more preferably, 0.1 to 5% by weight, with respect to the entire aqueous dispersion medium.

The dispersion stabilizer has a function for preventing droplets dispersed in the aqueous dispersion medium from aggregating. With respect to the dispersion stabilizer, a publicly known surfactant may be used; and any compound selected from the group consisting of a cationic surfactant, an anionic surfactant and a nonionic surfactant may be used. Two or more kinds of these surfactants may be used in combination.

Specific examples of the cationic surfactant include: dodecyl ammonium chloride, dodecyl ammonium bromide, dodecyl trimethyl ammonium bromide, dodecyl pyridinium chloride, dodecyl pyridinium bromide and hexadecyl trimethyl ammonium bromide. Specific examples of the anionic surfactant include fatty acid soap such as sodium stearate and sodium dodecanate, dodecylsodium sulfate and sodium dodecylbenzene sodium sulfonate. Specific examples of the nonionic surfactant include: dodecylpolyoxyethylene ether, hexadecylpolyoxyethylene ether, nonylphenylpolyoxyethylene ether, laurylpolyoxyethylene ether, sorbitan monooleate polyoxyethylene ether, styrylphenylpolyoxyethylene ether, and monodecanoyl sucrate. Among these, an anionic surfactant and/or a nonionic surfactant are preferably used. Although not particularly limited, an amount of addition of the dispersion stabilizer is normally set to 0.01 to 10% by weight, preferably 0.1 to 5% by weight, with respect to the entire aqueous dispersion medium.

Normally, a chain transfer agent is added to the polymerizable composition so as to control the molecular weight distribution of a polymer at the time of polymerization.

With respect to the chain transfer agent, in general, those of commercially available agents and those of synthesized agents may be used. Specific examples of the chain transfer agent include: octyl mercaptan, 2-mercaptooctyl propionate, 2-mercaptoethylene glycol propionate, heptylmercaptan, dodecylmercaptan, 2-mercaptopropionate 2-ethylhexyl and stearylmercaptan. Although different depending on a desired molecular weight and molecular weight distribution, an amount of addition of the chain transfer agent is preferably set to a range of 0.1 to 5% by weight with respect to the entire amount of the polymerizable monomer.

When resin fine particles in an emulsion state, obtained by an emulsion polymerization process, are associated and fused with at least a coloring agent, at least the coloring agent is allowed to adhere to the surface of the resin fine particles, and associated and fused thereon. More specifically, either of the following first method which includes a process in which a resin fine particle dispersion solution and a dispersion solution having at least the coloring agent dispersed therein (including a wax, a charge-controlling agent, magnetic particles, etc., if necessary) are mixed and stirred with each other so that associated particles between the resin fine particles and at least the coloring agent are formed (association process) and a process in which the associated particles are heated and fused to form toner particles (fusing process), and second method in which the associated particles are formed simultaneously as these particles are fused, may be used.

In particular, when wax is associated and fused with the resin fine particles, in the association process in the first method, it is preferable to mix and stir a dispersion solution of resin fine particles, a dispersion solution in which the coloring agent (a charge-controlling agent, magnetic particles etc., if necessary) is dispersed and a wax dispersion solution so that associated particles including the resin fine particles, the coloring agent and the wax are formed. In the second method, simultaneously as associated particles including the resin fine particles, the coloring agent and the wax are formed by using a dispersion solution of resin fine particles, a dispersion solution in which the coloring agent (a charge-controlling agent, magnetic particles etc., if necessary) is dispersed and a wax dispersion solution, the fusing process thereof is preferably carried out. The wax dispersion solution is prepared by adding the wax to an aqueous solution containing the dispersion stabilizer and heating and stirring the resultant solution.

In the association process of the first method, the associated particles are formed through hetero-coagulation and the like, and in this case, a coagulant may be added thereto in order to stabilize the associated particles and control the particle size and particle size distribution thereof. In the fusing process, the dispersion system is heated to a temperature higher than the glass transition point of the binder resin constituting the resin fine particles in the associated particles so that the associated particles are fused.

In the second method, the coagulant is added to the dispersion system in which the respective dispersion solutions are mixed so as to exceed the critical coagulation density, and the resultant solution is heated to a temperature exceeding the glass transition point of the binder resin constituting the resin fine particles so that the fusing process is carried out simultaneously as the formation of the associated particles progresses.

With respect to the coagulant used in the first and second methods, examples thereof include: the above-mentioned water-soluble surfactant such as a cationic surfactant, an anionic surfactant and a nonionic surfactant; acids such as hydrochloric acid, sulfuric acid, nitric acid, acetic acid and oxalic acid; metal salts of inorganic acids such as magnesium chloride, calcium chloride, sodium chloride, aluminum chloride, aluminum sulfate, calcium sulfate, aluminum nitrate, silver nitrate, copper sulfate and sodium carbonate; metal salts of aliphatic acids and aromatic acids such as sodium acetate, potassium formate, sodium oxalate, sodium phthalate and potassium salicylate; metal salts of phenols such as sodium phenolate; metal salts of amino acids such as aspartic acid; and salts of inorganic acids of aliphatic and aromatic amines such as triethanol amine hydrochloride and aniline hydrochloride. From the viewpoint of the stability of associated particles, stability of the coagulant with respect to heat and time-based endurance and removing property thereof at the time of washing, metal salts of inorganic acids are preferably used with high performances and applicability.

In the case of metal salts, an amount of addition of the coagulant depends on the number of valence of charge; however, it is set to a small level of not more than 3% by weight in any of coagulants. The smaller the amount of addition of the coagulant, the more preferable, and a compound having a higher number of valence is more preferably used since the compound makes it possible to reduce the amount of addition.

In the first method, it is preferable to adjoin an adhesion process in which a dispersion solution of organic fine particles is added to and mixed with an associated-particle dispersion solution so that the organic fine particles are allowed to uniformly adhere to the surface of the associated particles to form adhesion particles, after the association process prior to the fusing process. In the second method, it is preferable to adjoin an adhesion process in which a dispersion solution of organic fine particles is added to and mixed with a fusing-particle dispersion solution so that the organic fine particles are allowed to uniformly adhere to the surface of the fused particles to form adhesion particles, after the association and fusing process. The adhesion particles are formed through hetero-coagulation or the like.

In the first method, the organic fine particles thus adhered are fused with the resin fine particles in the succeeding fusing process. In the second method, in the same manner as the fusing process in the first method, the organic fine particles are fused with the resin fine particles by heating the dispersion system to a temperature of not less than the glass transition point of the resin fine particles. In any of the first and second methods, the fusing process may be carried out simultaneously as the formation process of the adhesion particles progresses.

After being allowed to adhere to the associated particles or fused particles, the organic fine particles are subsequently fused with the resin fine particles, so that it is possible to form desired particle size and shape, and also to make the particle-size distribution sharper.

With respect to the organic fine particles, for example, styrene resins, acrylic resins, polyester resins and the like may be used. A volume-mean particle size of the organic fine particles is preferably set to not more than 1 $\mu$m, more preferably in a range of 0.01 to 1 $\mu$m.

After at least a coloring agent is associated and fused with the resin fine particles, the fine particles are taken out of the dispersion system, and impurities immixed therein during the preparation process are removed through a washing process. The resultant particles are dried to give an electrostatic-latent-image developing toner.

In the washing process, acidic water, or basic water depending on cases, is added to the fine particles with the amount of addition being set to several times the amount the fine particles, and the mixture is stirred, and then filtered to give a solid matter. Pure water is added to the solid matter with the amount of addition being set to several times the amount thereof, and the resultant mixture is stirred, and then filtered. These processes are carried out a plurality of times, and stopped when the filtered solution after the filtration has reached pH of approximately 7. Thus, colored toner particles are obtained.

In the drying process, the toner particles, obtained through the washing process, are dried at a temperature of not more than the glass transition point of the binding resin. At this time, methods in which dried air is circulated in accordance with a required temperature, or a heating process is carried out under a vacuum state, may be used. In the drying process, any desired method may be selected from the normal methods such as a vibration-type fluidized drying method, a spray drying method, a freeze-drying method, a flash jet method and the like.

The following description will briefly explain cases in which the toner of the present invention is prepared by using an emulsion polymerization method, a suspension polymerization method, an emulsion dispersion method and a pulverizing method.

In the emulsion polymerization method and the suspension polymerization method, a polymerizable composition containing a polymerizable monomer, a coloring agent and wax as well as other additives is emulsified or suspended in an aqueous dispersion medium, and polymerized. The resultant matter is washed and dried to give toner particles.

In the emulsion dispersion method, the binder resin, coloring agent and wax as well as other additives are dissolved or dispersed in an appropriate organic solvent to form a colored resin solution. The resultant solution is added to an aqueous dispersion medium, and is stirred strongly to form droplets of the resin solution. Thereafter, the resultant solution is heated so that the organic solvent is removed from the droplets. The resultant matter is washed and dried to give toner particles.

In the pulverizing method, the binder resin, coloring agent and wax as well as other additives are mixed by a known mixing device such as Henschel mixer, and the resultant matter is then fused and kneaded by a known kneading device, and cooled to give a kneaded matter. With respect to the kneading device, those having one or two or more rotation axes (screws, rotors, rolls, etc.) are used. From the viewpoint of continuous productivity, long-term endurance, etc., a screw extruder, for example, a twin-screw extruding kneader (PCM-30: made by Ikegai Tekkou K.K.), may be used in most cases.

Then, the kneaded matter is pulverized, classified, and subjected to a surface-modifying process, if necessary. In the pulverizing process, normally, after the kneaded matter is coarsely pulverized by a feather mill or the like, this is finely pulverized by using a mechanical pulverizing device such as Criptron System (KTM: made by Kawasaki Jyukogyo K.K.) in which a high-speed flow impact method is adopted and/or a jet mill such as Jet Grinder (IDS: made by Nippon Pneumatic MFG.) in which toner particles are carried by a jet flow and allowed to collide into an impact plate or toner particles are allowed to collide with each other so as to be pulverized. With respect to the classifying device to be used in the classifying process, any known classifying device may be used as long as the pulverized particles are classified into desired particle sizes. For example, a rotor-type classifier (Teeplex-type classifier 100ATP: made by Hosokawa Micron K.K.) may be used.

The toner pariticles of the present invention, which are prepared by using the above-mentioned method, may have inorganic fine particles and/or organic fine particles on the surface and inside of the toner particles. With respect to the inorganic fine particles, for example, silica, alumina, titania, magnetite, ferrite, cerium oxide, strontium titanate, conductive titania and the like in the form of fine particles may be used. With respect to the organic fine particles, the same resins as those used in the above-mentioned organic fine particles may be adopted. An amount of addition of these fine particles may be appropriately set, and normally set in a range of 0.05 to 10 parts by weight with respect to 100 parts by weight of the toner particles.

The toner of the present invention may contain a lubricant. With respect to the lubricant, for example, metal salts of higher fatty acids, such as metal salts of stearic acid, metal salts of oleic acid, metal salts of palmitic acid and metal salts of linolic acid, are exemplified.

The present invention is explained in detail by examples. In the following description, the term "parts" is referred to as "parts by weight".

EXAMPLE

The following waxes were used in the present examples:

<Preparation Method of Compound (19)>

Behenic acid and 2,2-bis(hydroxymethyl)1,3-propane diol were subjected to a dehydration-condensing reaction at 220° C. in a nitrogen atmosphere for 8 hours. After completion of the reaction, this was cooled to 80° C. at a cooling rate of 10° C./min, and subjected to a neutralizing reaction in a potassium hydroxide aqueous solution. Then, the resultant matter was washed, dehydrated and filtered to give compound (19).

With respect to other compounds (20), (21), (3), the same processes as those used in compound (19) were carried out by using the following carboxylic acids and alcohols to prepare these compounds.

Compound (20): Arachic acid and 2,2-bis(hydroxymethyl) 1,3-propane diol
Compound (21): Stearic acid and 2,2-bis(hydroxymethyl)1, 3-propane diol
Compound (3): Docosanic acid and docosanol <Refining Method>

Each of the above-mentioned compounds was refined through the following processes to prepare a wax that would exhibit no clear peak on the low-temperature side of the fusing peak.

The compound was heated to a temperature of not less than the fusing point, and fused. The fused compound was cooled to the fusing-point temperature before the refining process at a rate of 15° C./min so that the deposited solid matter was extracted as a refined compound.

With respect to waxes A to E, the above-mentioned refining processes were carried in the following number of times:

Wax A (Compound (19), fusing point before refining: 83.8° C., fusing point after refining: 85.5° C.): 3 times.
Wax B (Compound (19), fusing point before refining: 83.8° C., fusing point after refining: 86.0° C.): 5 times.
Wax C (Compound (20), fusing point before refining: 80.5° C., fusing point after refining: 82.3° C.): 3 times.
Wax D (Compound (21), fusing point before refining: 76.8° C., fusing point after refining: 78.0° C.): 3 times.
Wax E (Compound (3), fusing point before refining: 71.2° C., fusing point after refining: 73.6° C.): 3 times.

With respect to waxes F to H, the above-mentioned compounds (19), (20), (21) were used without refining.

A DSC curve was formed with respect to each of the waxes so that "the main peak temperature" was measured.

FIGS. 1 and 2 respectively show DSC curves of waxes A and F.

In the DSC curves, "peaks that appear on the low-temperature side of the main peak" were evaluated in the following method. When a plurality of peaks appeared on the low-temperature side, the height of the greatest peak was set to "$h_x$" and when one peak appeared on the low-temperature side, the height of the corresponding peak was set to "$h_x$". The height of the main peak was set to "$h_0$".

"Presence"; $h_x/h_0 \geqq 0.05$;

"Absence"; "No peak existed on the low-temperature side.", or $h_x/h_0 < 0.05$.

TABLE 1

| Wax | Compound | Main peak temperature (° C.) | Peak on low-temperature side |
|---|---|---|---|
| A | (19) | 85.5 | Absence |
| B | (19) | 86.0 | Absence |
| C | (20) | 82.3 | Absence |
| D | (21) | 78.0 | Absence |
| E | (3) | 73.6 | Absence |
| F | (19) | 83.8 | Presence |
| G | (20) | 80.5 | Presence |
| H | (21) | 76.8 | Presence |

Example 1

To a reaction flask provided with a stirring device, a heating-cooling device, a condenser and a material-assistant loading device was loaded a solution prepared by dissolving 1.4 parts of dodecyl sulfonic acid soda in 600 parts of ion exchange water, and the inner temperature was raised to 80° C. while being stirred at a stirring rate of 200 rpm under a nitrogen flow. To this solution was added a solution prepared by dissolving 1.8 parts of potassium persulfate in 40 parts of ion exchange water. After set to a temperature of 75° C., a monomer mixed solution containing 14 parts of styrene, 4 parts of n-butylacrylate, 2 parts of methacrylic acid and 1.0 part of octyl mercaptan was dripped in 30 minutes, so that a polymerization process was carried out at 75° C. in this system to give latex A1.

Next, to a reaction flask provided with a stirring device, a heating-cooling device, a condenser and a material-assistant loading device was loaded a monomer mixed solution containing 21 parts of styrene, 6 parts of n-butyl acrylate, 1.3 parts of methacrylic acid and 1.2 parts of octylmercaptan, and to this was added 14 parts of wax A, and the resultant mixture was heated to 85° C. and dissolved to prepare a monomer solution. On other hand, a solution, prepared by dissolving 0.3 parts of dodecylsulfonic acid soda in 540 parts of ion exchange water, was heated to 80° C., and after 5.6 parts of the above-mentioned latex A1 on the basis of solids was added to this solution, the above-mentioned monomer solution was mixed and dispersed by a homogenizer TK homomixer (made by Tokushu Kika Kogyo K.K.), so that an emulsion solution was prepared. To this emulsion solution were added a solution prepared by dissolving 1 part of potassium persulfate in 50 parts of ion exchange water, and 150 parts of ion exchange water. After set to 80° C., this was subjected to a polymerization process for 3 hours to give latex B1.

To latex B1 obtained as described above was added a solution prepared by dissolving 1.5 parts of potassium persulfate in 40 parts of ion exchange water. After the temperature thereof set to 80° C., to this was dripped a monomer mixed solution containing 60 parts of styrene, 19 parts of n-butylacrylate, 3 parts of methacrylic acid and 2.1 parts of octylmercaptan in 30 minutes. After this system was subjected to a polymerizing process for 2 hours at 80° C., this was cooled to 30° C. to give latex C1.

To 300 parts of ion exchange water was dissolved 12 parts of n-dodecyl sodium sulfate while being stirred. While this solution was being stirred, 84 parts of carbon black (Regal 330: Cabot Co., Ltd.) was gradually dripped, and then dispersed by using TK homomixer (made by Tokushu Kika Kogyo K.K.) to give a dispersion solution of a coloring agent.

The above-mentioned latex C1 (84 parts) (as expressed in terms of solids), 180 parts of ion exchange water and 33 parts of the above-mentioned coloring agent dispersion solution were put into a reaction flask provided with a stirring device, a heating-cooling device, a condenser and a material-assistant loading device, and stirred. After the inner temperature was set to 30° C., a 5N water solution of sodium hydroxide was added to this, so that pH value was adjusted to 11.0. A solution prepared by dissolving 2.4 parts of magnesium chloride 6 hydrate in 200 parts of ion exchange water was dripped therein at 30° C. in 10 minutes. Thereafter, this system was heated to 90° C. in 6 minutes. To this was added a solution prepared by dissolving 16 parts of sodium chloride in 200 parts of ion exchange water, so that the growth of particles was stopped, and this was continuously subjected to a fusing process for 2 hours at a solution temperature of 85° C. as an aging process. Thereafter, this solution was cooled to 30° C. Hydrochloric acid was added thereto to adjust pH value to 2.0, and the stirring process was stopped. The fused particles thus generated were filtered, repeatedly washed with ion exchange water, and then dried by hot air of 40° C., so that colored particles 1 having a volume-mean particle size of 6.3 $\mu$m were obtained.

Hydrophobic silica (0.3 parts) (H-2000; made by Wacker Co., Ltd.) and hydrophobic titanium oxide (0.5 parts) (T-805: made by Nippon Aerosil K.K.) were added to 100 parts of the resultant colored particles 1, and the mixture was subjected to a post process by using Henschel mixer (made by Mitsui Miike Kakouki K.K.) at 1000 rpm for 1 minute to give toner A.

Example 2

To a reaction flask provided with a stirring device, a heating-cooling device, a condenser and a material-assistant loading device was loaded a solution prepared by dissolving 1.4 parts of dodecyl sulfonic acid soda in 600 parts of ion exchange water, and the inner temperature was raised to 80° C. while being stirred at a stirring rate of 200 rpm under a nitrogen flow. To this solution was added a solution prepared by dissolving 1.8 parts of potassium persulfate in 40 parts of ion exchange water. After set to a temperature of 75° C., a monomer mixed solution containing 15 parts of styrene, 4 parts of n-butylacrylate, 3 parts of methacrylic acid and 1.1 parts of 2-mercapto octyl propionate was dripped in 30 minutes so that a polymerization process was carried out at 75° C. in this system to prepare latex A1.

To a reaction flask provided with a stirring device, a heating-cooling device, a condenser and a material-assistant loading device was loaded a monomer mixed solution containing 20 parts of styrene, 5 parts of n-butyl acrylate, 1.5 parts of methacrylic acid and 1.0 part of 2-mercapto octyl propionate, and to this was added 14 parts of wax B. The resultant mixture was heated to 87° C. and dissolved to prepare a monomer solution. On the other hand, a solution prepared by dissolving 0.3 parts of dodecylsulfonic acid soda in 540 parts of ion exchange water was heated to 80° C. After 5.6 parts of the above-mentioned latex A2 on the basis of solids was added to this solution, the above-mentioned monomer solution was mixed and dispersed by a homogenizer TK homomixer (made by Tokushu Kika Kogyo K.K.), so that an emulsion solution was prepared. To this emulsion solution were added a solution prepared by dissolving 1 part of potassium persulfate in 50 parts of ion exchange water, and 150 parts of ion exchange water, and after set to 80° C., this was subjected to a polymerization process for 3 hours to give latex B2.

To latex B2 obtained as described above was added a solution prepared by dissolving 1.5 parts of potassium persulfate in 40 parts of ion exchange water. After the temperature thereof was set to 80° C., to this was dripped a monomer mixed solution containing 60 parts of styrene, 18 parts of n-butylacrylate, 2.1 parts of methacrylic acid and 1.8 parts of 2-mercapto octyl propionate in 30 minutes. After this system was subjected to a polymerizing process for 2 hours at 80° C., this was cooled to 30° C. to give latex C2.

To 300 parts of ion exchange water was dissolved 12 parts of n-dodecyl sodium sulfate while being stirred. While this solution was being stirred, 84 parts of carbon black (Regal 330: Cabot Co., Ltd.) was gradually dripped, and then dispersed by using TK homomixer (made by Tokushu Kika Kogyo K.K.) to give a dispersion solution of a coloring agent.

The above-mentioned latex C2 (84 parts) (as expressed in terms of solids), 180 parts of ion exchange water and 33 parts of the above-mentioned coloring agent dispersion solution were put into a reaction flask provided with a stirring device, a heating-cooling device, a condenser and a material-assistant loading device, and stirred. After the inner temperature was set to 30° C., a 5N water solution of sodium hydroxide was added to this so that pH value was adjusted to 11.0. A solution, prepared by dissolving 2.4 parts of magnesium chloride 6 hydrate in 200 parts of ion exchange water was dripped therein at 30° C. in 10 minutes. Thereafter, this system was heated to 90° C. in 6 minutes. Then, to this was added a solution prepared by dissolving 16 parts of sodium chloride in 200 parts of ion exchange water, so that the growth of particles was stopped, and this was continuously subjected to a fusing process for 2 hours at a solution temperature of 85° C. as an aging process. Thereafter, this solution was cooled to 30° C., hydrochloric acid was added thereto to adjust pH value to 2.0, and the stirring process was stopped. The fused particles thus generated were filtered, repeatedly washed with ion exchange water, and then dried by hot air of 40° C., so that colored particles 2 having a volume-mean particle size of 6.1 $\mu$m were obtained.

Hydrophobic silica (0.3 parts) (H-2000; made by Wacker Co., Ltd.) and hydrophobic titanium oxide (0.5 parts) (T-805: made by Nippon Aerosil K.K.) were added to 100 parts of the resultant colored particles 2, and the mixture was subjected to a post process by using Henschel mixer (made by Mitsui Miike Kakouki K.K.) at 1000 rpm for 1 minute to give toner B.

Example 3

To a reaction flask provided with a stirring device, a heating-cooling device, a condenser and a material-assistant loading device was loaded a monomer mixed solution containing 21 parts of styrene, 6 parts of n-butyl acrylate, 1.3 parts of methacrylic acid and 1.1 parts of octylmercaptan. To this was added 14 parts of wax C, and the resultant mixture was heated to 83° C. and dissolved to prepare a monomer solution. On the other hand, a solution prepared by dissolving 0.3 parts of dodecylsulfonic acid soda in 540 parts of ion exchange water was heated to 80° C. After 5.6 parts of latex A1 prepared in Example 1 on the basis of solids was added to this solution, the above-mentioned monomer solution was mixed and dispersed by a homogenizer TK homomixer (made by Tokushu Kika Kogyo K.K.), so that an emulsion solution was prepared. To this emulsion solution were added a solution prepared by dissolving 1 part of potassium persulfate in 50 parts of ion exchange water, and 150 parts of ion exchange water. After set to 80° C., this was subjected to a polymerization process for 3 hours to give latex B3.

To latex B3 obtained as described above was added a solution prepared by dissolving 1.5 parts of potassium persulfate in 40 parts of ion exchange water. After the temperature thereof was set to 80° C., to this was dripped a monomer mixed solution containing 60 parts of styrene, 19 parts of n-butylacrylate, 3 parts of methacrylic acid and 1.5 parts of octylmercaptan in 30 minutes, and after this system was subjected to a polymerizing process for 2 hours at 80° C., this was cooled to 30° C. to give latex C3.

To 320 parts of ion exchange water was dissolved 18 parts of n-dodecyl sodium sulfate while being stirred. While this solution was being stirred, 5.3 parts of red pigment (PR122: made by Dainichi Seika K.K.) was gradually added thereto, and then dispersed by using TK homomixer (made by Tokushu Kika Kogyo K.K.) to give a dispersion solution of a coloring agent.

The above-mentioned latex C3 (84 parts) (as expressed in terms of solids), 180 parts of ion exchange water and 33 parts of the above-mentioned coloring agent dispersion solution were put into a reaction flask provided with a stirring device, a heating-cooling device, a condenser and a material-assistant loading device, and stirred. After the inner temperature was set to 30° C., a 5N water solution of sodium hydroxide was added to this, so that pH value was adjusted to 11.0. A solution prepared by dissolving 2.4 parts of magnesium chloride 6 hydrate in 200 parts of ion exchange water was dripped therein at 30° C. in 10 minutes. Thereafter, this system was heated to 90° C. in 6 minutes. Then, to this was added a solution prepared by dissolving 16 parts of sodium chloride in 200 parts of ion exchange water, so that the growth of particles was stopped, and this was continuously subjected to a fusing process for 3 hours at a solution temperature of 85° C. as an aging process. Thereafter, this solution was cooled to 30° C., hydrochloric acid was added thereto to adjust pH value to 2.0, and the stirring process was stopped. The fused particles thus generated were filtered, repeatedly washed with ion exchange water, and dried by hot air of 40° C., so that colored particles 3 having a volume-mean particle size of 5.8 $\mu$m were obtained.

Hydrophobic silica (0.3 parts) (made by Wacker Co., Ltd.) and hydrophobic titanium oxide (0.5 parts) (T-805: made by Nippon Aerosil K.K.) were added to 100 parts of the resultant colored particles 3. The mixture was subjected to a post process by using Henschel mixer (made by Mitsui Miike Kakouki K.K.) at 1,000 rpm for 1 minute to give toner C.

Example 4

To a reaction flask provided with a stirring device, a heating-cooling device, a condenser and a material-assistant loading device was loaded a solution prepared by dissolving 1.4 parts of dodecyl sulfonic acid soda in 600 parts of ion exchange water, and the inner temperature was raised to 80° C. while being stirred at a stirring rate of 200 rpm under a nitrogen flow. To this solution was added a solution prepared by dissolving 1.8 parts of potassium persulfate in 40 parts of ion exchange water. After this was set to a temperature of 75° C., a monomer mixed solution containing 13 parts of styrene, 7 parts of n-butylacrylate, 2 parts of methacrylic acid and 0.8 parts of 2-mercapto ethylene glycol propionate was dripped in 30 minutes, so that a polymerization process was carried out at 75° C. in this system to prepare latex A3.

A reaction flask provided with a stirring device, a heating-cooling device, a condenser and a material-assistant loading device was loaded a monomer mixed solution containing 20 parts of styrene, 7 parts of n-butyl acrylate, 1.2 parts of methacrylic acid and 1.0 parts of 2-mercapto ethylene glycol propionate, and to this was added 14 parts of wax D. The resultant mixture was heated to 85° C. and dissolved to prepare a monomer solution. On the other hand, a solution prepared by dissolving 0.3 parts of dodecylsulfonic acid soda in 540 parts of ion exchange water was heated to 80° C., and after 5.6 parts of the above-mentioned latex A3 on the basis of solids was added to this solution. The above-mentioned monomer solution was mixed and dispersed by a homogenizer TK homomixer (made by Tokushu Kika Kogyo K.K.), so that an emulsion solution was prepared. To this emulsion solution were added a solution prepared by dissolving 1 part of potassium persulfate in 50 parts of ion exchange water, and 150 parts of ion exchange water. After set to 80° C., this was subjected to a polymerization process for 3 hours to give latex B4.

To latex B4 obtained as described above was added a solution prepared by dissolving 1.5 parts of potassium persulfate in 40 parts of ion exchange water. After the temperature thereof was set to 80° C., to this was dripped a monomer mixed solution containing 60 parts of styrene, 19 parts of n-butylacrylate, 3 parts of methacrylic acid and 1.8 parts of heptyl mercaptan in 30 minutes. After this system was subjected to a polymerizing process for 2 hours at 80° C., this was cooled to 30° C. to give latex C4.

To 320 parts of ion exchange water was dissolved 18 parts of n-dodecyl sodium sulfate while being stirred. While this solution was being stirred, 8.4 parts of yellow pigment (Pigment Yellow 74: made by Clariant Japan Corp.) was gradually dripped, and then dispersed by using TK homomixer (made by Tokushu Kika Kogyo K.K.) to give a dispersion solution of a coloring agent.

The above-mentioned latex C4 (84 parts) (as expressed in terms of solids), 180 parts of ion exchange water and 33 parts of the above-mentioned coloring agent dispersion solution were put into a reaction flask provided with a stirring device, a heating-cooling device, a condenser and a material-assistant loading device, and stirred. After the inner temperature was set to 30° C., a 5N water solution of sodium hydroxide was added to this so that pH value was adjusted to 11.0. A solution prepared by dissolving 2.4 parts of magnesium chloride 6 hydrate in 200 parts of ion exchange water was dripped therein at 30° C. in 10 minutes. Thereafter, this system was heated to 90° C. in 6 minutes. Then, to this was added a solution prepared by dissolving 16 parts of sodium chloride in 200 parts of ion exchange water, so that the growth of particles was stopped. This was continuously subjected to a fusing process for 4 hours at a solution temperature of 85° C. as an aging process. Thereafter, this solution was cooled to 30° C., hydrochloric acid was added thereto to adjust pH value to 2.0, and the stirring process was stopped. The fused particles thus generated were filtered, repeatedly washed with ion exchange water, and then dried by hot air of 40° C., so that colored particles 4 having a volume-mean particle size of 5.8 $\mu$m were obtained.

Hydrophobic silica (0.3 parts) (H-2000; made by Wacker Co., Ltd.) and hydrophobic titanium oxide (0.5 parts)

(T-805: made by Nippon Aerosil K.K.) were added to 100 parts of the resultant colored particles 4. The mixture was subjected to a post process by using Henschel mixer (made by Mitsui Miike Kakouki K.K.) at 1000 rpm for 1 minute to give toner D.

Example 5

To a reaction flask provided with a stirring device, a heating-cooling device, a condenser and a material-assistant loading device were loaded a solution prepared by mixing 270 parts of styrene, 30 parts of n-butyl acrylate, 5 parts of acrylic acid and 12 parts of octylmercaptan and a solution prepared by dissolving 6 parts of a nonionic surfactant (Nonypole 400: made by Sanyo Kasei K.K.) and 10 parts of an anionic surfactant (NEOGEN SC: made by Daiichi Kogyo Seiyaku K.K.) in 600 parts of ion exchange water. These solutions were dispersed, and emulsified. While this was stirred and mixed slowly for 10 minutes, 50 parts of ion exchange water with 4 parts of ammonium persulfate dissolved was added thereto. Then, after the inside of the flask was sufficiently substituted by nitrogen, the system was heated to 80° C. inside thereof while being stirred in an oil bath. In this state, the emulsification polymerization was continued for 5 hours. Thereafter, the reaction solution was cooled to room temperature to give latex D1.

To 120 parts of ion exchange water was dissolved 5 parts of n-dodecyl sodium sulfate while being stirred. While this solution was being stirred, 25 parts of yellow pigment (Pigment Yellow 180: made by Clariant Japan Corp.) was gradually added thereto, and then dispersed by using TK homomixer (made by Tokushu Kika Kogyo K.K.) to give a dispersion solution of a coloring agent.

To 150 parts of ion exchange water was dissolved 5 parts of n-dodecyl sodium sulfate while being stirred. While this solution was being stirred, 30 parts of wax E was added thereto, heated, dissolved at 75° C., and then dispersed by using TK homomixer (made by Tokushu Kika Kogyo K.K.) to give a dispersion solution of a mold-releasing agent.

The above-mentioned latex D1 (70 parts), 20 parts of the above-mentioned coloring-agent dispersion solution, 20 parts of the above-mentioned mold-releasing-agent dispersion solution and 0.8 parts of aluminum polyhydroxide (Asada Kagaku K.K.) were dispersed by using TK homomixer (made by Tokushu Kika Kogyo K.K.), and the resultant solution was put into a reaction flask provided with a stirring device, a heating-cooling device, a condenser and a material-assistant loading device, and stirred therein. The inner temperature thereof was set to 58° C. Thereafter, this solution was maintained at 58° C. for 2 hours. To this dispersion solution was gradually added 30 parts of latex D1. The temperature of the inside of the system was raised to 59° C., and maintained for 1 hour. Then, to the above-mentioned dispersion solution was added 2 parts of an anionic surfactant (NEOGEN SC: made by Daiichi Kogyo Seiyaku K.K.), so that the growth of particles was stopped, and this was continuously subjected to a fusing process for 4 hours at a solution temperature of 95° C. as an aging process. Thereafter, this solution was cooled to 30° C., and the stirring process was stopped. The fused particles thus generated were filtered with pH value being adjusted to 11.5 by adding a water solution of sodium hydroxide, and then washed at 40° C. The resultant particles were washed with ion exchange water repeatedly, and then dried by hot air at 40° C., so that colored particles 5 having a volume-mean particle size of 5.7 $\mu$m were obtained.

Hydrophobic silica (0.3 parts) (H-2000; made by Wacker Co., Ltd.) and hydrophobic titanium oxide (0.5 parts) (T-805: made by Nippon Aerosil K.K.) were added to 100 parts of the resultant colored particles 5, and the mixture was subjected to a post process by using Henschel mixer (made by Mitsui Miike Kakouki K.K.) at 1,000 rpm for 1 minute to give toner E.

Example 6

To a reaction flask provided with TK homomixer (made by Tokushu Kika Kogyo K.K.), a heating-cooling device, a condenser and a material-assistant loading device was loaded a solution prepared by dissolving 325 parts of ion exchange water and 41 parts of soda phosphate in 250 parts of ion exchange water. The temperature of the inside was raised to 80° C. while being stirred at a stirring rate of 12,000 rpm. To this solution was gradually added a solution prepared by dissolving 3.9 parts of calcium chloride in 31 parts of ion exchange water, so that an aqueous continuous phase containing a fine non-water-soluble dispersant of calcium phosphate was prepared.

A monomer mixed solution containing 83 parts of styrene, 17 parts of n-butylacrylate, 0.1 parts of divinylbenzene, 5 parts of carbon black, 5 parts of wax D, 2 parts of Cr-based dye (TRH: made by Hodogaya Kagaku K.K.) and 6 parts of t-butylperoxy-2-ethylhexanoate was uniformly mixed.

Then, the above-mentioned monomer mixed solution was put into the aforementioned aqueous continuous phase, and this was stirred by using TK homomixer (made by Tokushu Kika Kogyo K.K.) at 10,000 rpm for 10 minutes so that a granulating process was carried out. Thereafter, this was allowed react at 80° C. for 5 hours while being stirred by paddle stirring blades. After 4 parts of sodium carbonic anhydride was added to the system, the reaction was further continued for 2 hours. After the reaction, the resultant solution was cooled to 30° C., and hydrochloric acid was added thereto, so that pH value was adjusted to 2.0, and the stirring process was stopped. The suspension polymerized particles thus generated were filtered and dispersed in ion exchange water. Diluted hydrochloric acid (1N) was added thereto until the pH of the solution had reached 1.6 and calcium phosphate was dissolved. Thereafter, the resultant matter was washed with ion exchange water repeatedly, and filtered. The resultant particles were then dried by hot air at 40° C., so that colored particles 6 having a volume-mean particle size of 6.1 $\mu$m were obtained.

Hydrophobic silica (0.3 parts) (H-2000; made by Wacker Co., Ltd.) and hydrophobic titanium oxide (0.5 parts) (T-805: made by Nippon Aerosil K.K.) were added to 100 parts of the resultant colored particles 6, and the mixture was subjected to a post process by using Henschel mixer (made by Mitsui Miike Kakouki K.K.) at 1,000 rpm for 1 minute to give toner F.

Example 7

First, polyoxypropylene (2,2)-2,2-bis(4-hydroxyphenyl) propane, polyoxyethylene (2,0)-2,2-bis(4-hydroxyphenyl) propane and terephthalic acid were mixed so as to have a molar ratio of 3:7:9. This mixture was loaded into a four-neck flask equipped with a thermometer, a stirring rod made of stainless steel, a falling-type condenser and a nitrogen introducing tube together with dibutyl tin oxide.

The physical properties of the polyester resin thus obtained had a number-average molecular weight (Mn) of 3,300, a ratio of weight-average molecular weight (Mw)/number-average molecular weight (Mn) of 4.2, a glass transition point (Tg) of 68.5° C. and a softening point (Tm) of 110.3° C.

The polyester resin obtained as described above was coarsely pulverized to have a particle size of not more than 1 mm. This polyester resin and a yellow coloring agent of C.I. Pigment Yellow 180 (made by Clarient International Ltd.) were loaded into a pressure kneader so as to have a weight ratio of 7:3. After kneaded at 120° C. for 1 hour, this was cooled off, and then coarsely pulverized by a hammer mill, so that a pigment master batch having a yellow coloring agent content of 30% by weight.

The above-mentioned polyester resin, the pigment master batch and 1 part of wax A were sufficiently mixed by Henschel mixer at a peripheral velocity of 40 m/sec in 180 seconds so that 7 parts of yellow coloring agent C.I. pigment yellow 180 was contained in 100 parts of the above-mentioned polyester resin.

The resultant mixture was fused and kneaded by using a twin-axis extruder kneader (PCM-30 made by Ikegai Tekkou K.K.). The kneaded matter was rolled by a press roller to a thickness of 2 mm. After having been cooled by a cooling belt, this was coarsely pulverized by a feather mill. Thereafter, this is pulverized by using a mechanical pulverizing device (KTM: made by Kawasaki Jyukogyo K.K.), further finely pulverized by a jet mill pulverizer (IDS: made by Nippon Pneumatic MFG.), and then classified by using a rotor-type classifier (Teeplex-type classifier 100 ATP: made by Hosokawa Micron K.K.), so that colored fine particles having a volume-mean particle size of 6.5 μm were obtained.

Hydrophobic silica (0.3 parts) (H-2000; made by Wacker Co., Ltd.) and hydrophobic titanium oxide (0.5 parts) (T-805: made by Nippon Aerosil K.K.) were added to 100 parts of the resultant colored particles. The mixture was subjected to a post process by using Henschel mixer (made by Mitsui Miike Kakouki K. K.) at 1,000 rpm for 1 minute to give toner G.

Comparative Example 1

The same processes as example 1 were carried out except that wax F was used to give a toner. The resultant colored particles had a volume-mean particle size of 6.0 μm.

Comparative Example 2

The same processes as example 3 were carried out except that wax G was used to give a toner.

Comparative Example 3

The same processes as example 4 were carried out except that wax H was used to give a toner.

<Preparation Example of Carrier>

To a 500 ml reaction flask equipped with a stirring device, a condenser, a thermometer, a nitrogen introducing tube and a dripping device was loaded 100 parts by weight of methyl ethyl ketone. Methyl methacrylate(36.7 parts), 5.1 parts of 2-hydroxyethyl methacrylate and 58.2 parts of 3-methacryloxy propyl tris(trimethylsiloxy) silane and 1 part of 1,1'-azobis (cyclohexane-1-carbonitrile) were dissolved in 100 parts of methyl ethyl ketone at 80° C. in a separated manner. Resultant solution was dripped in a reaction container in 2 hours, and subjected to an aging process for 5 hours.

To the resultant resin solution was added an isophorone diisocyanate/trimethylol propane adduct (IPDI/TPM based: NCO %=6.1%) so that a OH/NCO molar ratio was set to 1/1, and then diluted by methyl ethyl ketone to give a coat resin solution having a solid ratio of 3% by weight.

Calcined ferrite particles (average-particle size 40 μm) was used as a core material. The above-mentioned coat resin solution was applied onto the core material by SPIRA COTA (Okada Seiko K.K.) with an amount of coated resin being set to 1.5% by weight with respect to the core material, and dried. The carrier thus obtained was left in a hot-air circulation-type oven at 160° C. for 1 hour so as to be calcined. The resultant carrier had an average particle size of 41 μm with an electric resistance of approximately $3\times10^{10}$ Ωcm.

Evaluation

The toners of the above-mentioned examples and comparative examples were evaluated for the following characteristics. Table 2 shows the results.

Quantity of Charge

A developer for use in evaluation was prepared by mixing a toner and the above-mentioned carrier at a weight ratio of 5:95. This developer (30 g) was put into a polyethylene bottle having a capacity of 50 ml, and rotated at 1,200 rpm for 90 minutes so that the developer was stirred. The resultant toner was made in contact with a film charged to a predetermined quantity of electrical charge, and the quantity of charge of the toner was found by measuring a weight of the toner adhering to the film.

Image Quality

A developer, prepared by mixing a toner with the above-mentioned carrier, was loaded to a developing device of a commercially available color copying machine (DiALTA Color CF2002: made by Minolta K.K with an oil-less fixing device), and evaluated for image quality. More specifically, based upon images in the initial state and images in the state after printing processes of 10,000 copies, the evaluation was made in the following manner. With respect to example 7, the evaluation was made by using a flash fixing device as an external fixing device.

◎: No granular noise appeared, and images were excellent;

○: Although granular noise slightly appeared, images were good with no problem caused in practical use;

Δ: Granular noise partially appeared, causing problems in practical use;

×: Granular noise appeared entirely;

××: Serious degradation appeared in image quality.

Cleaning Property

After 10,000 copies were made, evaluation was also made for cleaning property. More specifically, the surface of the photosensitive member and images after printing processes of 10,000 copies were observed as to whether or not any fusion or residual toner appeared thereon, to be ranked as follows;

Fusion

○: No fusion appeared on the surface of the photosensitive member;

Δ: Little fusion appeared partially on the surface of the photosensitive member; however, no adverse effect was observed on an image, causing no problems in practical use;

×: Big fusion appeared on the surface of the photosensitive member, causing stains on an image due to fusion.

Residual toner

○: No residual toner appeared on the surface of the photosensitive member;

Δ: Residual toner slightly appeared on the surface of the photosensitive member; however, no adverse effect was observed on an image, causing no problems in practical use;

×: Serious residual toner appeared on the surface of the photosensitive member, causing stains on an image due to residual toner.

TABLE 2

| | | Initial | After endurance printing processes of 10000 copies | | | Quantitiy |
|---|---|---|---|---|---|---|
| | Wax | Image Quality | Image Quality | Residual Toner | Fusion | of Charge (μC/g) |
| Example 1 | A | ◎ | ○ | ○ | ○ | 39 |
| Example 2 | B | ◎ | ◎ | ○ | ○ | 40 |
| Example 3 | C | ◎ | ○ | ○ | ○ | 38 |
| Example 4 | D | ◎ | ○ | ○ | ○ | 40 |
| Example 5 | E | ◎ | ○ | ○ | ○ | 39 |
| Example 6 | D | ◎ | ○ | ○ | ○ | 38 |
| Example 7 | A | ◎ | ○ | ○ | ○ | 37 |
| Comparative Example 1 | F | ◎ | x | Δ | Δ | 36 |
| Comparative Example 2 | G | ◎ | x | Δ | Δ | 35 |
| Comparative Example 3 | H | ◎ | x | x | x | 34 |

The volume-mean particle size was measured by using a laser-diffraction-type particle-size distribution measuring device (Master Sizer 2000; made by Sysmex Corporation)

The toner of the present invention makes it possible to prevent insufficient cleaning and toner adhesion to members such as rollers for a long time.

By using a specific ester-based wax, it becomes possible to prevent insufficient cleaning, generation of granular noise and toner adhesion to members such as rollers for a long time, and also to make an oil-less fixing process possible.

When the toner of the present invention is prepared through a wet method, it is possible to easily provide a toner that has a small particle size and a narrow particle-size distribution, and such a toner makes it possible to easily reproduce a high-precision image.

What is claimed is:

1. An electrostatic-latent-image developing toner comprising colored particles, wherein said colored particles comprises resin fine particles and a wax represented by the following formula (1), the wax exhibiting no peak having a height of not less than 5% of the height of the main peak on a low-temperature side of a main peak that shows heat absorption in a DSC curve that indicates a process of a temperature-rise of the wax from a solid state to a fused state;

$$R_1—(OCO—R_2)_n \quad (1)$$

in which $R_1$ and $R_2$ independently represent an optionally substituted hydrocarbon group having 1 to 40 carbon atoms, and n is an integer of 1 to 4.

2. The toner according to claim 1, wherein said wax has a melting point in a range from 60° C. to 110° C.

3. The toner according to claim 1, wherein said resin fine particles are prepared by an emulsion dispersion method, and said colored particles are prepared by coagulating/fusing the resin fine particles and a coloring agent.

4. The toner according to claim 1, wherein in said DSC curve, there is no peak except for said main peak or there is only the peak that has a height not more than 5% of the height of the main peak.

5. The toner according to claim 3, wherein the resin fine particles comprises a styrene-acrylic copolymer.

6. The toner according to claim 3, wherein said toner has a volume-mean particle size in a range of 3 to 7 μm.

7. The toner according to claim 3, wherein said emulsion polymerization is carried out through multiple stages.

8. The toner according to claim 7, wherein said polymerizing processes of multiple stages include a first polymerizing process and a second polymerizing process that follows the first polymerizing process, with said wax being added in said first polymerizing process.

9. The toner according to claim 7, wherein said polymerizing processes of multiple stages include a first polymerizing process, a second polymerizing process that follows the first polymerizing process and a third polymerizing process that follows the second polymerizing process, with said wax being added in said second polymerizing process.

10. The toner according to claim 1, wherein said wax is contained at a content of 1 to 25 parts by weight with respect to 100 parts by weight of the resin that is formed through an emulsion polymerization process.

11. The toner according to claim 1, wherein said toner is prepared by a pulverizing method.

12. The toner according to claim 1, wherein $R_1$ and $R_2$ independently represent an optionally substituted hydrocarbon group having 10 to 30 carbon atoms.

13. The toner according to claim 5, wherein said styrene-acrylic copolymer is prepared by co-polymerizing a styrene-based monomer and a (meth)acrylate-based monomer in a copolymerization ratio of 20/80 to 90/10 in weight ratio.

14. The toner according to claim 5, wherein said styrene-acrylic copolymer is prepared by co-polymerizing a third vinyl compound.

15. The toner according to claim 1, wherein the colored particles are black.

16. The toner according to claim 1, wherein coloring agent fine particles having a color other than black are used.

17. An electrostatic-latent-image developing toner, prepared by coagulating and fusing a coloring agent and resin fine particles formed of a styrene-acrylic copolymer obtained by an emulsion-polymerization method, and having a volume-mean particle size of 3 to 7 μm, wherein said resin fine particles comprise 1 to 25 parts by weight of a wax represented by the following formula (1) with respect to 100 parts by weight of resin that is formed by an emulsion polymerization, the wax having a melting point in a range of 60° C. to 110° C., with no peak having a height of not less than 5% of the height of the main peak on a low-temperature side of a main peak that shows heat absorption in a DSC curve that indicates a process of a temperature-rise of the wax from a solid state to a fused state;

$$R_1—(OCO—R_2)_n \quad (1)$$

in which $R_1$ and $R_2$ independently represent an optionally substituted hydrocarbon group having 10 to 30 carbon atoms, and n is an integer of 2 to 4.

18. The toner according to claim 17, wherein said wax is contained at a content of 1 to 25 parts by weight with respect to 100 parts by weight of the resin that is formed through an emulsion polymerization process.

19. An electrostatic-latent-image developing toner having a volume-mean particle size of 3 to 7 μm, prepared through the steps comprising;

mixing a resin, a coloring agent and a wax represented by the following formula (1), kneading the resultant mixed matter, pulverizing the resultant kneaded matter, and classifying the resultant pulverized matter, the wax having a melting point in a range of 60° C. to 110° C., with no peak having a height of not less than 5% of the height of the main peak on a low-temperature side of a main peak that shows heat absorption in a DSC curve that indicates a process of a temperature-rise of the wax from a solid state to a fused state;

$$R_1—(OCO—R_2)_n \quad (1)$$

in which R1 and R2 independently represent an optionally substituted hydrocarbon group having 10 to 30 carbon atoms, and n is an integer of 2 to 4.

* * * * *